United States Patent [19]

Sasaki et al.

[11] Patent Number: 5,021,614

[45] Date of Patent: Jun. 4, 1991

[54] POWER SEAT DEVICE

[75] Inventors: Makoto Sasaki; Nobuo Ebishi; Shinji Yanai, all of Furukawa, Japan

[73] Assignee: Alps Electric Co., Ltd., Tokyo, Japan

[21] Appl. No.: 348,614

[22] Filed: May 5, 1989

[30] Foreign Application Priority Data

Jul. 25, 1988 [JP] Japan ..... 63-97346[U]

[51] Int. Cl.[5] ..... H01H 3/00; H01H 9/20

[52] U.S. Cl. ..... 200/5 R; 200/18; 200/50 C

[58] Field of Search ..... 200/5 R, 6 R, 6 A, 17 R, 200/18, 557, 330, 339, 50 C

[56] References Cited

U.S. PATENT DOCUMENTS

| | | | |
|---|---|---|---|
| 2,823,272 | 2/1958 | Adams | 200/18 X |
| 2,906,832 | 9/1959 | Foster et al. | 200/18 |
| 3,071,658 | 1/1963 | Demarest | 200/5 R |
| 3,135,839 | 6/1964 | Colautti et al. | 200/5 R |
| 4,107,499 | 8/1978 | Weidler | 200/18 X |
| 4,115,670 | 9/1978 | Chandler | 200/18 X |
| 4,695,682 | 9/1987 | Winogrocki | 200/5 R |

*Primary Examiner*—J. R. Scott

*Attorney, Agent, or Firm*—Guy W. Shoup; Paul J. Winters

[57] ABSTRACT

A power seat switch device for adjusting a seat position having a single operating knob, a sliding member cooperatively connected to the operating knob, and three lever switches adapted to be selectively operated by the motion of the sliding member. When the common operating knob is moved in one of two opposite directions, the first switch is operated to move the seat to the front and to the rear. On the other hand, when the operating knob is rotated at one end, the sliding member is pivoted about the third switch, thereby operating the second switch. As a result, the height of the front portion of the seat is adjusted. In contrast, when the operating knob is rotated at its other end, the sliding member is pivoted about the second switch, thereby operating the third switch. As a result, the height of the rear portion of the seat is adjusted.

2 Claims, 3 Drawing Sheets

FIG. 1
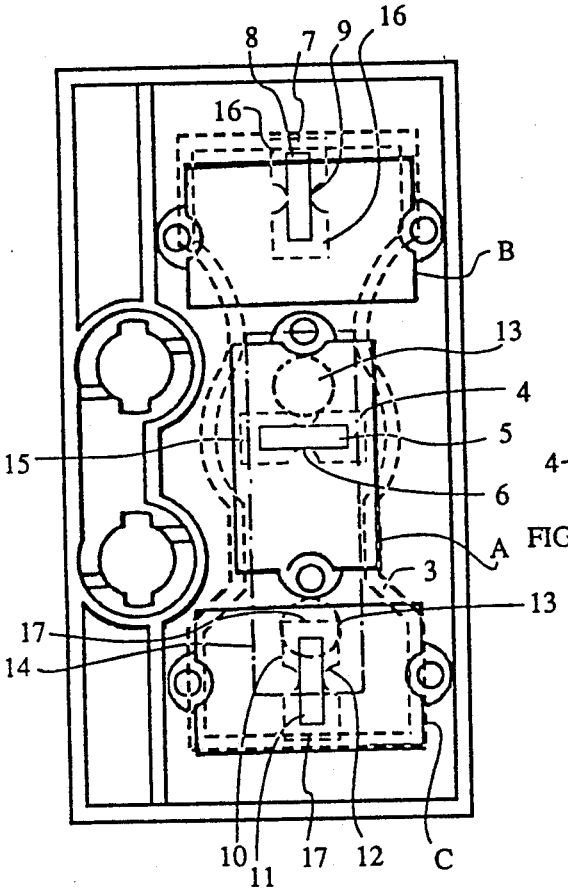
FIG. 2
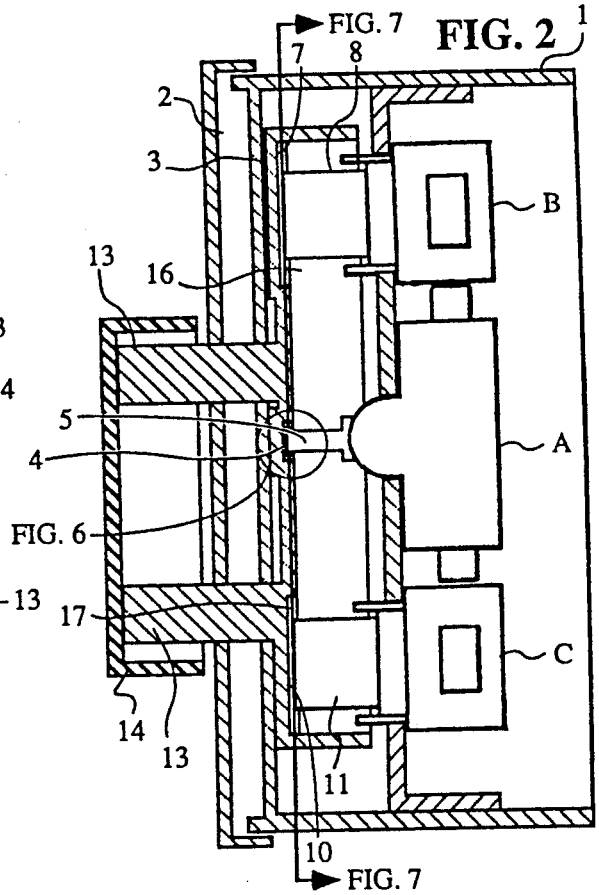
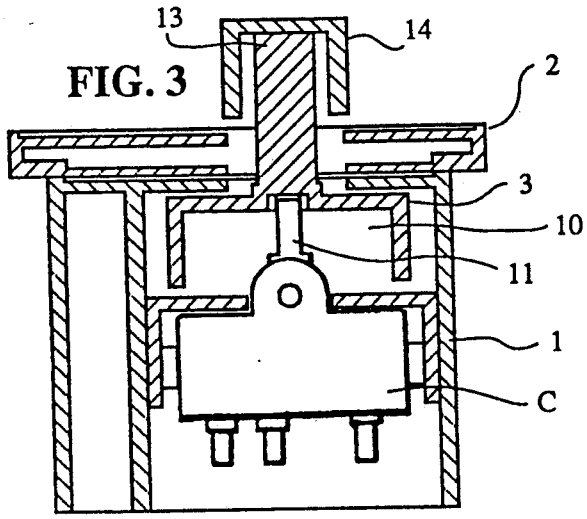
FIG. 3
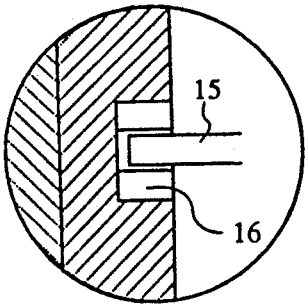
FIG. 6

POWER SEAT DEVICE

FIELD OF THE INVENTION

This invention relates to a switch operator for manipulating switches which operate motors to adjust a power seat.

BACKGROUND OF THE INVENTION

The present invention relates to a power seat switch device for moving an automotive seat to the front and rear, and adjusting heights of front and rear portions of the seat in accordance with a driver's figure.

In a conventional power seat switch device for use with an automobile, three independent switches are provided on the side of the seat; the first switch being capable of moving the seat to the front and rear, the second switch being capable of adjusting the height of the front portion of the seat, and the third switch being capable of adjusting the height of the rear portion of the seat.

However, when an operator intends to adjust a seat position, he is obliged to independently operate three knobs corresponding to the three switches, causing troublesome operability. Further, the provision of the independent knobs corresponding to the switches causes an increased number of parts, resulting in an increase in cost.

SUMMARY OF THE INVENTION

It is an object of the present invention to provide a power seat switch device which may improve the switch operability and reduce the number of parts.

According to the present invention, a device is provided comprising a single operating knob; a sliding member cooperatively connected to said operating knob, said sliding member having formed on its inner surface first, second and third grooves, said first groove being disposed between said second and third grooves in perpendicular relationship thereto; a first switch having a lever loosely engaged with said first groove of said sliding member in such a manner that a pair of gaps are defined between opposite ends of said lever of said first switch and opposite ends of said first groove, respectively; a second switch having a lever loosely engaged with said second groove of said sliding member in such a manner that a pair of gaps are defined between opposite ends of said lever of said second switch and opposite ends of said second groove, respectively; a third switch having a lever loosely engaged with said third groove in such a manner that a pair of gaps are defined between opposite ends of said lever of said third switch and opposite ends of said third groove, respectively; a first pair of projections formed on opposed inner surfaces of said first groove for supporting said lever of said first switch; a second pair of projections formed on opposed inner surfaces of said second groove for supporting said lever of said second switch; and a third pair of projections formed on opposed inner surfaces of said third groove for supporting said lever of said third switch.

With this arrangement, when the common operating knob is moved linearly in opposite directions, the first switch is operated to move the seat to the front and rear. On the other hand, when the common knob is rotated at a first end, the sliding member is pivoted about the third pair of projections of the third groove supporting the lever of the third switch, thereby operating the second switch. As a result, the height of the front portion of the seat is adjusted. In contrast, when the common operating knob is rotated at a second end, the sliding member is pivoted about the second pair of projections of the second groove supporting the lever of the second switch, thereby operating the third switch. As a result, the height of the rear portion of the seat is adjusted.

Other objects and features of the invention will be more fully understood from the following detailed description and appended claims when taken with the accompanying drawings.

BRIEF DESCRIPTION OF THE DRAWINGS

FIG. 1 is a plan view of the power seat switch device according to the present invention;

FIG. 2 is a cutaway sectional view looking from the right side of FIG. 1 with the casing and operating members section and cutaway around switches A, B, C unsectioned;

FIG. 3 is a cutaway sectional view taken along the lower side of FIG. 1 leaving the switch C unsectioned;

FIG. 6 is an enlarged circular cross-sectional view taken along the circular section line 6—6 in FIG. 2.

DETAILED DESCRIPTION OF THE PREFERRED EMBODIMENT

Figure 4:
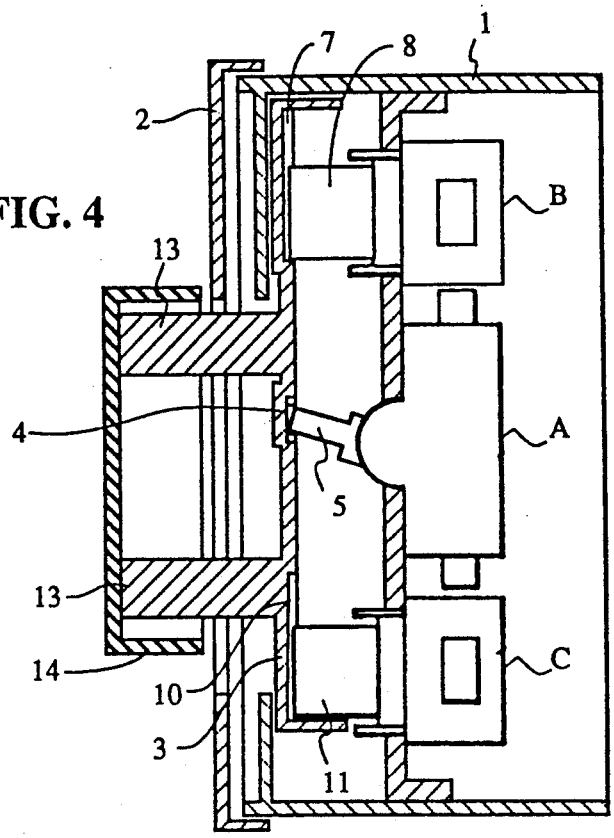
FIG. 4 is a view similar to FIG. 2, illustrating an operative condition of switch A.

There will now be described a preferred embodiment of the present invention with reference to the drawings.

Reference numeral 1 designates a casing of a power seat switch device. The casing 1 is covered at its open top with a cover member 2. A sliding member 3 is movably encased in the casing 1. The sliding member 3 has a bottom surface formed with a central first groove 4 laterally extending as viewed in FIG. 1. The first groove 4 has formed on its opposite side surfaces a pair of arcuate projections 6 for supporting a lever 5 of a lever switch A for adjusting a seat position in a longitudinal direction of an automobile. The sliding member 3 further has formed on its bottom surface, above the first groove 4 as viewed in FIG. 1, a vertically elongated second groove 7 extending in a perpendicular relationship to the first groove 4. The second groove 7 has formed on its opposite side surfaces a pair of arcuate projections 9 for supporting a lever 8 of a lever switch B for adjusting a height of a front portion of an automotive seat (not shown). The sliding member 3 further has formed on its bottom surface, below the first groove 4 as viewed in FIG. 1, a vertically elongated third groove 10 extending in a perpendicular relationship to the first groove 4. The third groove 10 has formed on its opposite side surfaces a pair of arcuate projections 12 for supporting a lever 11 of a lever switch C for adjusting a height of a rear portion of the seat. The sliding member 3 is connected through a pair of connecting rods 13 to an operating knob 14. FIG. 1 shows an inoperative condition of the switch assembly. There are a pair of gaps 15 between one end of the first groove 4 and one end of the lever 5 opposed thereto and between the other end of the first groove 4 and the other end of the lever 5 opposed thereto. Similarly, there are a pair of gaps 16 between opposite ends of the second groove 7 and opposite ends of the lever 8, respectively, and a pair of gaps 17 are defined between opposite ends of the third groove 10 and opposite ends of the lever 11, respectively.

Although not shown, the lever switches A, B and C encase return springs for biasing the levers 5, 8 and 11 of the lever switches A, B and C, respectively, to neutral positions of the levers 5, 8 and 11 when an operating force applied to the operating knob 14 is removed.

In operation, when the operating knob 14 is moved downward from the inoperative or neutral position shown in FIG. 2, the sliding member 3 is simultaneously moved in the same direction. This movement of the sliding member 3 causes engagement of the one side of the first groove 4 with the lever 5 of the lever switch A, thereby inclining the lever 5 counterclockwise as would be viewed in FIG. 4 and effecting an ON state between one contact and a common contact in the lever switch A. As a result, the seat is moved to the rear through a power transmitting system (not shown). During this operation of the lever switch A, there occurs no engagement between the one end of the second groove 7 of the sliding member 3 and the lever 8 of the lever switch B because there is a gap 16 therebetween. Similarly, there is no engagement between the one end of the third groove 10 of the sliding member 3 and the lever 11 of the lever switch C because there is a gap 17 therebetween. Thereafter, when the downward operating force applied to the operating knob 14 is removed, the knob 14 is returned to its neutral position as a result of the force applied by a return spring encased in the lever switch A.

In contrast, when the operating knob 14 is moved upward from the neutral position shown in FIG. 2, the lever 5 of the lever switch A is inclined clockwise as shown in FIG. 4, thereby effecting an ON state between an other contact and the common contact. As a result, the seat is moved to the front through the power transmitting system. During this operation of the lever switch A, there is no engagement between the other end of the second groove 7 and the lever 8 because of the gap 16 therebetween. Similarly, there is no engagement between the other end of the third groove 10 and the lever 11 because of the gap 17 therebetween. Thereafter, when the upward operating force applied to the operating knob 14 is removed, the knob 14 returns to the neutral position as a result of the force applied by a return spring encased in the lever switch A.

Figure 5:
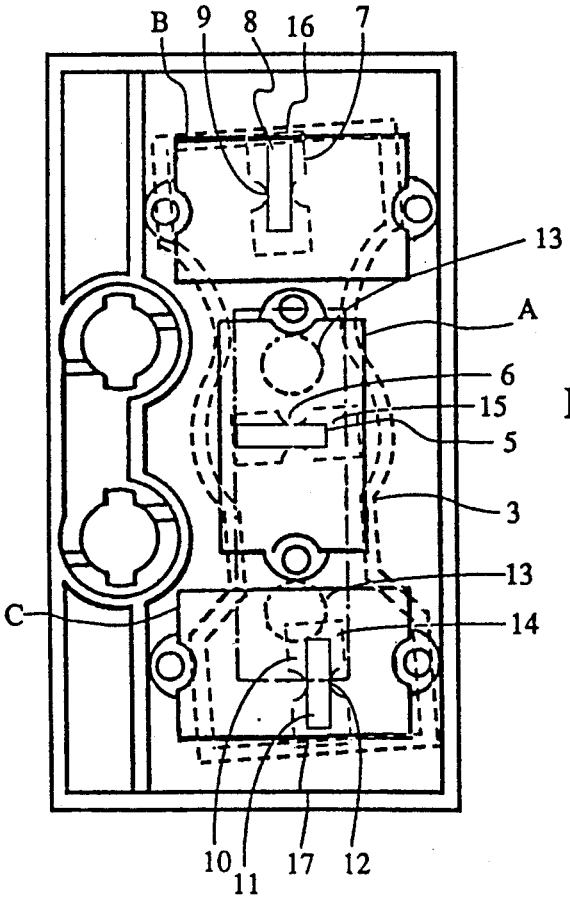
FIG. 5 is a view similar to FIG. 1, illustrating an operative condition of switch C.
Figure 7:
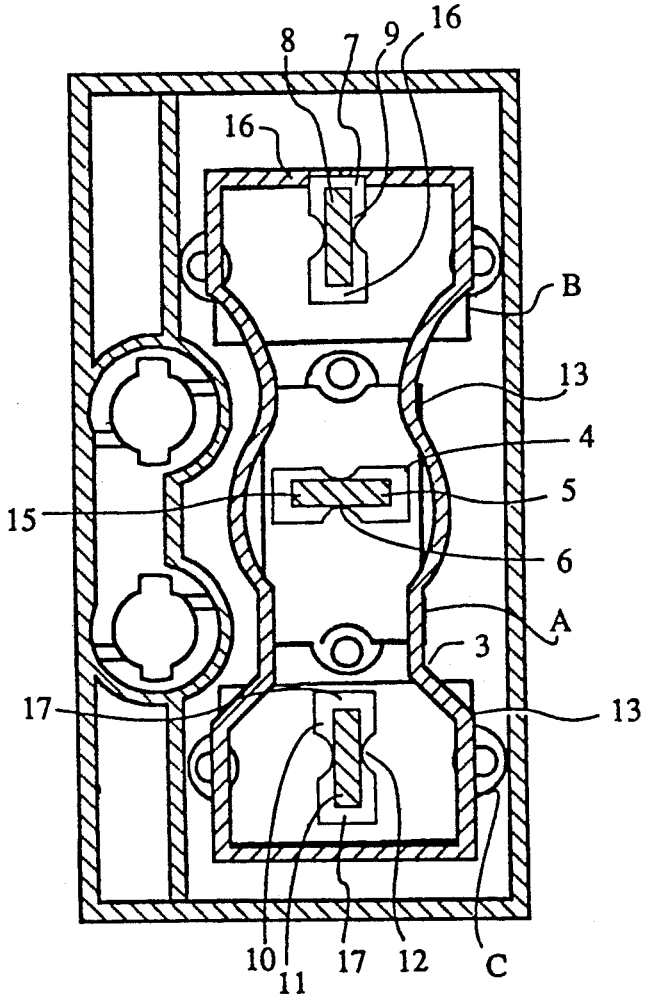
FIG. 7 is a sectional view taken along section 7—7 of FIG. 2.

When the operating knob 14 is rotated counterclockwise at its lower end as shown in FIG. 5 from the neutral position sown in FIG. 1, the sliding member 3 is simultaneously rotated counterclockwise about the arcuate projections 9 of the second groove 7, supporting the lever 8 of the lever switch B, as a pivot point. As a result, the lever 11 of the lever switch C is urged rightward as viewed in FIG. 3 by the arcuate projections 12 of the third groove 10, and would be inclined clockwise if shown in FIG. 3, thereby effecting an ON state between one contact and a common contact in the lever switch C. As a result, a rear portion of the seat is raised through a power transmitting system (not shown). During this operation of the lever switch C, there is no inclination of the lever 5 of the lever switch A because the direction of the pivotal movement of the sliding member 3 is substantially the same as the longitudinal direction of the lever 5, and accordingly the arcuate projections 6 of the first groove 4 slide along the longitudinal direction of the lever 5. Furthermore, there is no inclination of the lever 8 of the lever switch B because the lever 8 supported by the arcuate projections 9 of the second groove 7 is the pivot point. Thereafter, when the pivotal operating force applied to the operating knob 14 is removed, the knob 14 is returned to the neutral position as a result of the force applied by a return spring encased in the lever switch C.

In contrast, when the operating knob 14 is rotated clockwise at its lower end as viewed in FIG. 1 from the neutral position, the lever 11 is inclined counterclockwise as would be viewed in FIG. 3 by the sliding member 3, thereby effecting an ON state between the other contact and the common contact. As a result, the rear portion of the seat is lowered through the power transmitting system. Thereafter, when the pivotal operating force applied to the operating knob 14 is removed, the knob 14 is returned to the neutral position as a result of the force applied by a return spring encased in the lever switch C.

On the other hand, when the upper end of the operating knob 14 is rotated counterclockwise as viewed in FIG. 1 from the neutral position, the sliding member 3 is simultaneously rotated counterclockwise about the arcuate projections 12 of the third groove 10 supporting the lever 11 of the lever switch C establishing it as a pivot point. As a result, the lever 8 of the lever switch B is urged leftward as viewed in FIG. 1 by an arcuate projection 9 of the second groove 7, and is inclined counterclockwise as would be viewed in FIG. 3 (Although FIG. 3 shows a sectional view taken on the side of the lever switch C, the same construction applies to the lever switch B), thereby effecting an ON state between one contact and a common contact in the lever switch B. As a result, a front portion of the seat is lowered through a power transmitting system (not shown). During this operation of the lever switch B, there is no inclination of the levers 5 and 11 of the lever switches A and C, respectively, for substantially the same reasons as set forth previously. Thereafter, when the pivotal operating force applied to the operating knob 14 is removed, the knob 14 returns to the neutral position as a result of the force applied by a return spring encased in the lever switch B.

In contrast, when the upper end of the operating knob 14 is rotated clockwise as viewed in FIG. 1 from the neutral position, the lever 8 is inclined clockwise as would be viewed in FIG. 3 by the sliding member 3, thereby effecting an ON state between the other contact and the common contact. As a result, the front portion of the seat is raised through the power transmitting system. Thereafter, when the pivotal operating force applied to the operating knob 14 is removed, the knob 14 is returned to the neutral position as a result of the force applied by a return spring encased in the lever switch B.

In summary, when the knob 14 is moved to the front or to the rear, the seat is moved to the front or to the rear, respectively. On the other hand, when the knob 14 is rotated at its lower (back) end counterclockwise or clockwise, the rear portion of the seat is raised or lowered, respectively. In contrast, when the knob 14 is rotated at its upper (front) end counterclockwise or clockwise, the front portion of the seat is lowered or raised, respectively. Accordingly, the operability of the switch assembly may be improved as compared with the prior art employing the independent knobs. Furthermore, the number of parts of the switch assembly may be reduced, resulting in a reduction in cost.

Although the lever switches A, B and C are used in the above preferred embodiment, they may be replaced by slide switches.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

We claim:

1. A power seat switch device comprising:

a single operating knob;

a sliding member cooperatively connected to said operating knob, said sliding member having an inner surface with a first, a second, and a third groove formed therein, said second and third grooves being disposed in a parallel relationship to each other, said first groove being disposed between said second and third grooves in perpendicular relationship thereto, wherein each of said grooves has a first end and a second end and two sides;

a first switch disposed in the switch device having a lever, said lever having a first end and a second end and two sides, wherein said lever is engaged with said first groove of said sliding member in such a manner that a pair of gaps are defined between said first and second ends of said lever of said first switch and said first and second ends of said first groove, respectively;

a second switch disposed in the switch device having a lever, said lever having a first end and a second end and two sides, wherein said lever is engaged with said second groove of said sliding member in such a manner that a pair of gaps are defined between said first and second ends of said lever of said second switch and said first and second ends of said second groove, respectively;

a third switch disposed in the switch device having a lever, said lever having a first end and a second end and two sides, wherein said lever is engaged with said third groove in such a manner that a pair of gaps are defined between said first and second ends of said lever of said third switch and said first and second ends of said third groove, respectively;

a first pair of projections formed on said two sides of said first groove contacting said two sides of said lever of said first switch; and a second pair of projections formed said two sides of said second groove contacting said two sides of said lever of said second switch; and a third pair of projections formed said two sides of said third groove contacting said two sides of said lever of said third switch.

2. A power seat switch device wherein said first, second, and third pairs of projections are arcuate projections.

* * * * *